US008342804B2

(12) United States Patent
Pronovost et al.

(10) Patent No.: US 8,342,804 B2
(45) Date of Patent: Jan. 1, 2013

(54) ROTOR DISC AND METHOD OF BALANCING

(75) Inventors: Christian Pronovost, Boucherville (CA); Joseph Daniel Lecuyer, Verdun (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1079 days.

(21) Appl. No.: 12/241,467

(22) Filed: Sep. 30, 2008

(65) Prior Publication Data

US 2010/0080705 A1 Apr. 1, 2010

(51) Int. Cl.
*F01D 5/02* (2006.01)

(52) U.S. Cl. ..... 416/144; 416/182; 73/469

(58) Field of Classification Search ..... 416/144, 416/145, 182; 29/889.2, 889.23; 73/469, 73/470

See application file for complete search history.

(56) References Cited

U.S. PATENT DOCUMENTS

| | | | | |
|---|---|---|---|---|
| 3,817,149 | A | | 6/1974 | Reutlinger |
| 4,836,755 | A | | 6/1989 | Nitsche et al. |
| 4,986,149 | A | | 1/1991 | Carmel et al. |
| 5,206,988 | A | | 5/1993 | Piramoon |
| 5,461,791 | A | * | 10/1995 | Piety ..... 33/1 N |
| 5,483,855 | A | | 1/1996 | Julow et al. |
| 5,586,625 | A | | 12/1996 | Julow et al. |
| 5,823,304 | A | | 10/1998 | Wagg |
| 5,871,314 | A | * | 2/1999 | Trionfetti ..... 409/165 |
| 6,354,780 | B1 | | 3/2002 | Davis et al. |
| 6,405,434 | B2 | | 6/2002 | Landolt et al. |
| 6,471,452 | B2 | | 10/2002 | Trionfetti |
| 6,520,012 | B1 | * | 2/2003 | Schonfeld ..... 73/462 |
| 6,532,848 | B1 | | 3/2003 | DeRegnaucourt et al. |
| 7,069,654 | B2 | | 7/2006 | Robbins |
| 7,210,226 | B2 | | 5/2007 | Makinson et al. |
| 7,305,762 | B2 | | 12/2007 | Mola |

* cited by examiner

*Primary Examiner* — Tuan N. Quach

(74) *Attorney, Agent, or Firm* — Norton Rose Canada LLP

(57) ABSTRACT

A rotor disc, such as one made of a damage intolerant material or other material sensitive to stress concentrations, has at least one balancing assembly which includes a plurality of circumferentially spaced-apart sacrificial protrusions projecting between adjacent stress-relieving slots. Selective material removal is permitted from the rotor disc, while managing stress concentrations in the rotor disc created by such material removal, such that the rotor disc may be balanced without detrimentally affecting its service life.

10 Claims, 3 Drawing Sheets

ROTOR DISC AND METHOD OF BALANCING

TECHNICAL FIELD

The technical field relates generally to rotor discs and rotor disc balancing for turbomachines.

BACKGROUND

Turbomachines often comprise rotor discs, each configured with a generally radially outer rim to which are connected a row of circumferentially-disposed blades. Rotor discs are designed to withstand the centrifugal loads developed by the blades as the rotor discs rotate at very high speeds about a central axis and also other loads resulting from forces acting on the blades during operation of the turbomachines. The strength of rotor discs is generally calculated so as to be maximized while their weight is minimized. The rotor discs are designed to withstand the various loads during their entire planned service life.

The balancing of rotor discs must be done before putting them into service and also after a maintenance operation. A balancing operation is generally carried out with the blades mounted on a rotor disc, the rotor disc and the blades forming a rotor disc assembly. Various balancing techniques exist. Some involve a repositioning of the blades around the rotor discs. Others involve adding balancing weights to the rotor disc or removing material from the rotor discs, for example by machining holes therein. However, adding or removing weight on rotor discs can locally increase internal stresses during rotation, especially when high strength alloys developed for high speed rotor discs are used. These alloys have a lower damage tolerance compared to other materials and can be prone to crack propagation, for instance around holes that may be provided for attaching balancing weights or in areas where material is removed for balancing. Room for improvements thus exists.

SUMMARY

In one aspect, the present concept provides a gas turbine rotor disc comprising a plurality of circumferentially sacrificial protrusions delimited circumferentially by stress-relieving slots disposed between and defining the protrusions, the protrusions provided in a circular array coaxially disposed with reference to a central rotation axis of the rotor disc, the protrusions projecting from a bottom end of adjacent slots to a free end, the protrusions configured to permit selective removal of a portion of the free end to thereby balance the rotor.

In another aspect, the present concept provides a method of manufacturing a turbomachine rotor disc, the method comprising: providing the turbomachine rotor disc with at least one generally annular appendage coaxially disposed with reference to a central rotation axis of the turbomachine rotor disc; and machining a plurality of spaced-apart and substantially radially-extending slots in a free end of the appendage, the slots delimiting a plurality of sacrificial protrusions from which material can be removed during balancing.

In a further aspect, the present concept provides a method for gas turbine rotor disc balancing comprising the steps of: providing a rotor disc having at least one balancing assembly provided substantially coaxially with reference a rotation axis of the rotor disc, the balancing assembly having a plurality of spaced-apart sacrificial protrusions extending between adjacent stress-relieving slots, bottoms of said adjacent slots defining a base end of the protrusions, each protrusion extending from its base end to a free end, the slots provided with a shape providing a stress concentration below a crack propagation threshold in a region of the slot bottoms; determining an imbalance to the rotor disc; and then remedying the imbalance by permanently removing material from the free end of at least one of the sacrificial protrusions.

Further details on these and other aspects will be apparent from the detailed description and figures included below.

DETAILED DESCRIPTION

Figure 1:
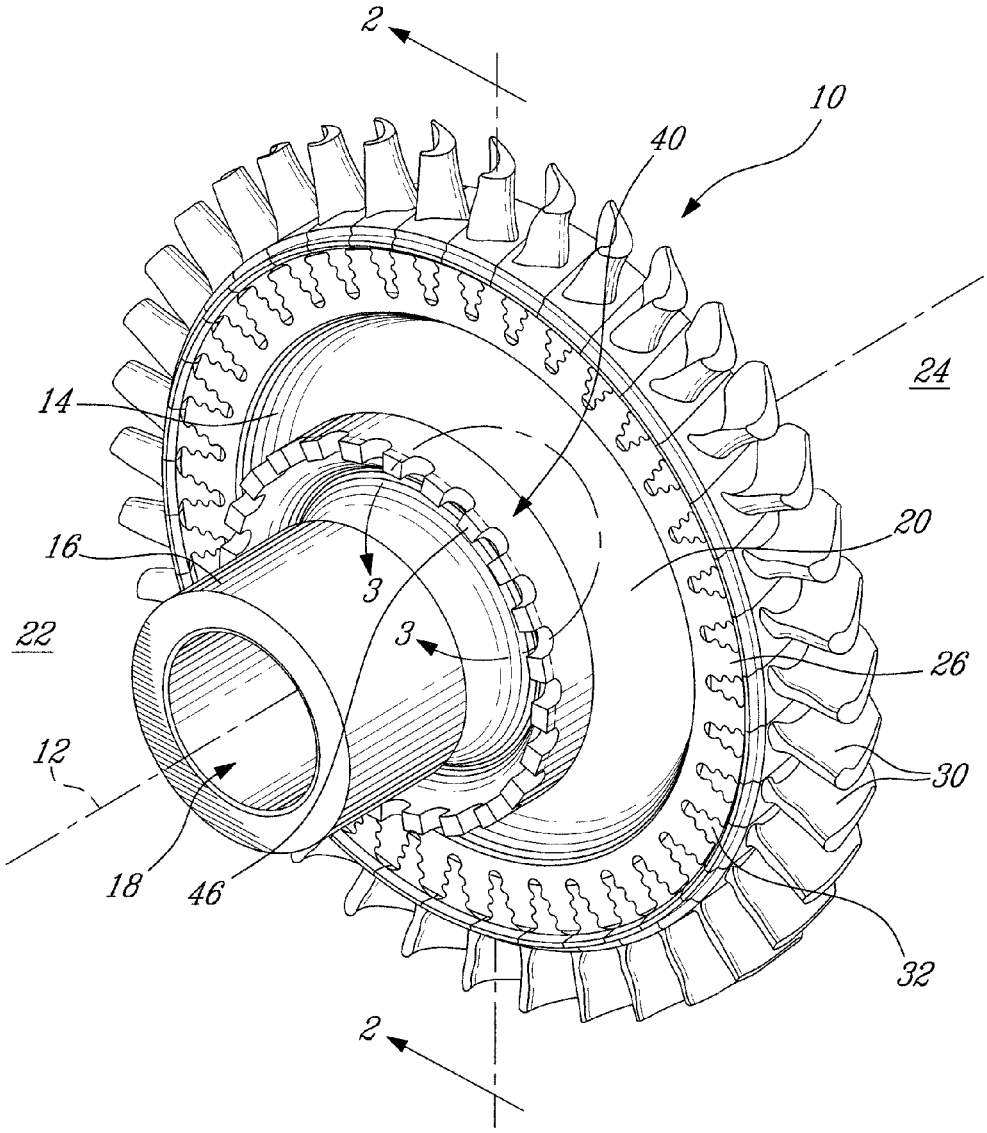
FIG. 1 is an isometric view showing an example of a rotor disc assembly with a rotor disc as improved.

FIG. 1 is an isometric view showing an example of a turbomachine rotor disc assembly 10 designed for rotation around a central rotation axis 12. The assembly 10 includes a rotor disc 14 to be mounted around a drive shaft (not shown). The rotor disc 14 includes a hub portion 16 having a central bore 18 through which the drive shaft is inserted.

Figure 2:
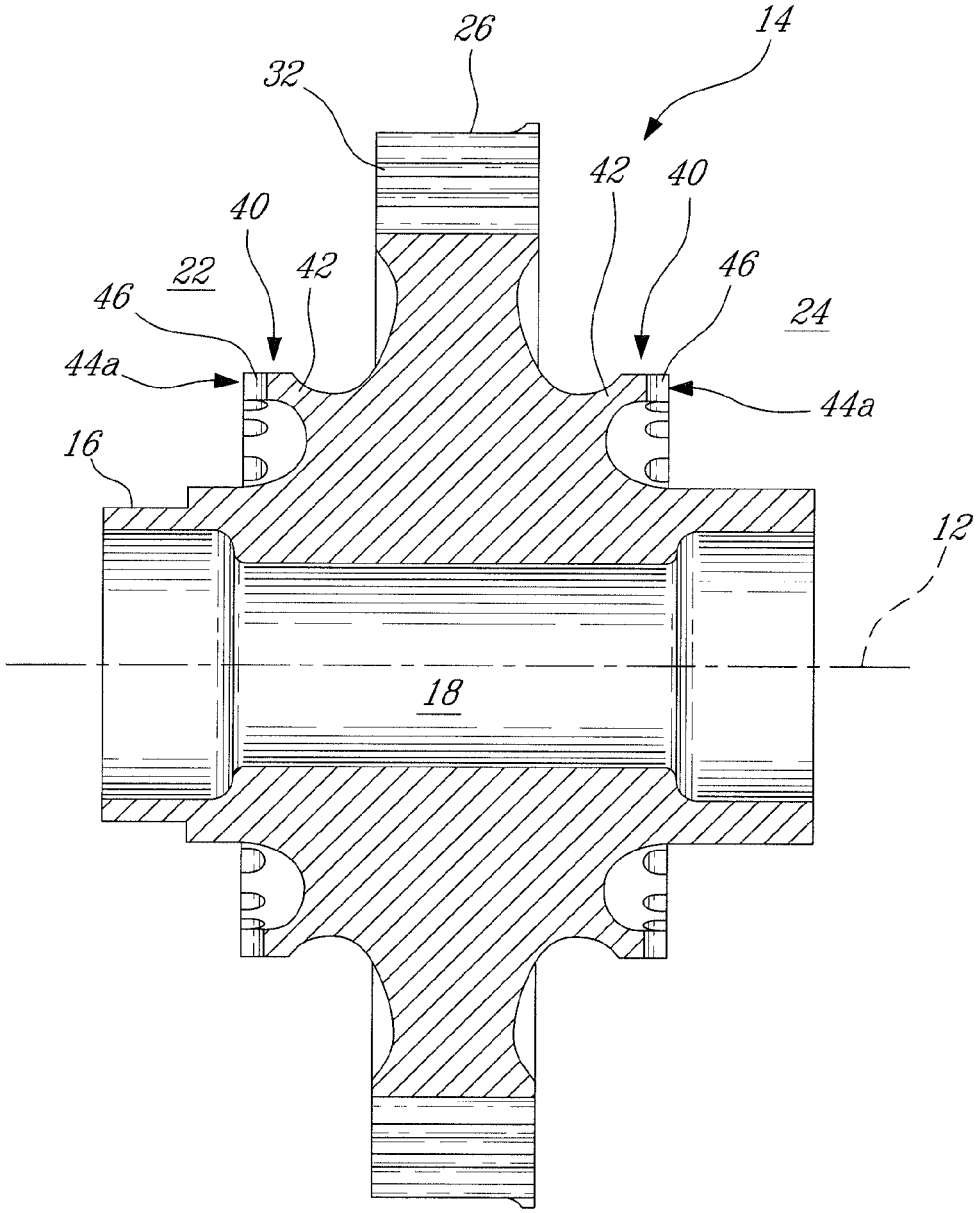
FIG. 2 is a cross-sectional view of the rotor disc alone taken along line 2-2 in FIG. 1.

As best shown in FIG. 2, which is a cross-sectional view of the rotor disc 14 alone according to line 2-2 in FIG. 1, the rotor disc 14 includes a web portion 20 extending generally radially from the hub portion 16. The rotor disc 14 also has two opposite faces 22, 24.

The outer periphery of the rotor disc 14 includes a rim portion 26 encircling the web portion 20. The hub portion 16, the web portion 20 and the rim portion 26 in the illustrated example are made integral with each other and form a monolithic piece. The monolithic rotor disc 14 can be made of a single material. Other rotor disc constructions are possible as well.

The rotor disc assembly 10 shown in FIG. 1 includes a plurality of circumferentially-disposed and radially extending blades 30 mounted in corresponding blade-receiving slots 32 provided in the rim portion 26 for receiving roots of the blades 30. The slots 32 are designed to prevent the blades 30 from being ejected radially during rotation. Other components (not shown), such as fixing rivets, spring plates, etc., can also be provided in the rotor disc assembly 10, depending on the design. It should be noted that blades 30 can be made integral with the rotor disc 14 in some designs, thereby forming a monolithic assembly that is sometimes called a blink.

The illustrated rotor disc 14 comprises two rotor balancing assemblies 40, in this example provided by circular and scalloped appendages 40, one on each face 22, 24. Each appendage 40 is coaxially disposed with reference to the central rotation axis 12. Although the illustrated example shows two appendages 40, it is possible to provide only one instead of two. The sole appendage could then be on either face 22 or face 24. It is also possible to provide two or more appendages on one side and none or a different number on the other side. Still, any appendage on one side does not need to be identical in size and/or in shape compared to any appendage on the other side.

As best shown in FIG. 2, each appendage 40 comprises a base portion 42 that can be integrally connected to the web portion 20, thereby being part of the monolithic rotor disc 14.

It is also possible to provide an appendage elsewhere on the rotor disc 14, such as on the rim portion 26 or on the hub portion 16 for instance.

The base portion 42 of the appendage 40 is circumferentially continuous in the illustrated example but it is also possible to design an appendage with discrete segments individually connected to the web portion 20 or elsewhere on the rotor disc 14. These segments would be circumferentially disposed to form together an appendage. Still, appendage(s) 40 can be connected to the rest of the rotor disc 14 without being made integral thereto. For example, an appendage could be connected by welding or gluing, by using fasteners, etc.

Each appendage 40 may be configured and disposed so as to form a generally annular portion of the rotor disc 14 where internal stresses during operation of the turbomachine will be below the crack propagation threshold. In the illustrated example, the appendages 40 do not support any other portion or component and are simply freely hanging on their respective side of the rotor disc 14. The internal stresses are thus much lower in use than those of the web portion 20, for instance.

Each appendage 40 includes a plurality of circumferentially spaced-apart sacrificial protrusions 46 at a free end thereof. These sacrificial protrusions 46 are the locations where weight can be removed from the rotor disc 14 during balancing. The sacrificial protrusions 46 project substantially axially from the base portion 42 of the corresponding appendage 40.

Figure 3:
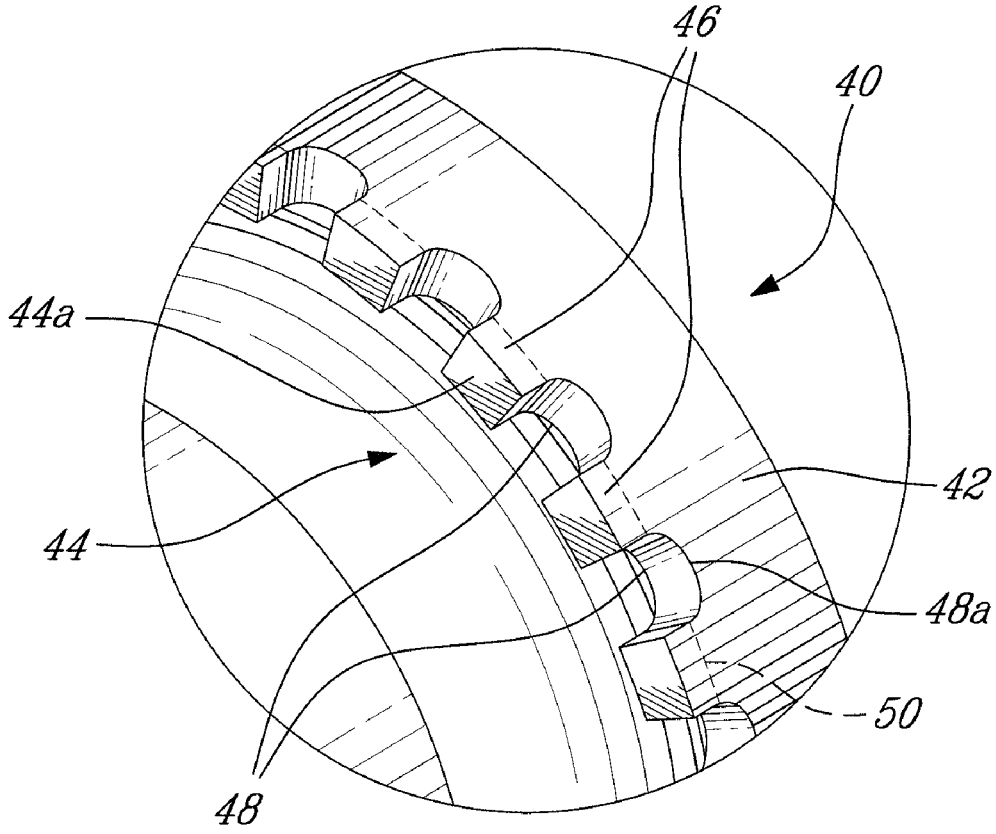
FIG. 3 is an enlarged view of the scalloped appendage shown in FIG. 1.

FIG. 3 is an enlarged view showing some of the sacrificial protrusions 46 on the scalloped appendage 40 in FIG. 1. The sacrificial protrusions 46 are axisymmetrically disposed with reference to the central rotation axis 12. The sacrificial protrusions 46 are substantially identical when the rotor disc 14 is new. The size and shape of the sacrificial protrusions 46 are chosen so as to provide the possibility of balancing the rotor disc assembly 10 in the worst possible imbalance scenario. They can also be designed to provide the possibility of carrying out one or more additional balancing operations where one or more protrusions 46 will have some of their material removed even if some of it was already removed during a previous balancing. Such additional balancing operations can be required after a maintenance operation, for instance after replacing or repairing one or more blades 30. Various techniques can be used to define the sacrificial protrusion geometry. A person skilled in the art will know how to proceed and therefore, these techniques need not be discussed in further details.

The sacrificial protrusions 46 are delimited circumferentially by a plurality of stress-relieving slots 48, provided in this example by axisymmetrically spaced-apart scallop-shaped slots 48. These slots 48 are configured to act as stress relieving slots to prevent the internal stresses due to the material removal in the sacrificial protrusions 46 from initiating and propagating cracks to the other portions of the rotor disc 14, as discussed further below. The slots are provided, in this example, on the radially-extending end face 44*a* at the free end 44 of the appendage 40 illustrated in FIG. 1. Each one of the slots 48 has an internal wall with a shape or slope minimizing the stress concentration in the bottom end 48*a* of the slot 48. The slots 48 are designed so as to reduce the internal stresses (hoop stress) caused by the rotation of the rotor disc 14 in operation, thus allowing material removal by standards means. This arrangement mitigates the risks of crack propagation if the rotor disc 14 is made of a damage intolerant material prone to crack propagation or another material sensitive to stress concentrations. When manufacturing the rotor disc 14, the slots 48 can be machined in the free end 44 of the appendage 40, for instance by using a rotating tool or another technique. Each slot 48 of the illustrated example is oriented substantially radially with reference to the central axis 12, its central axis being somewhat parallel to a radial direction.

Balancing the rotor disc assembly 10 is made by removing material only from the sacrificial protrusions 46. Material is permanently removed from one or more of the sacrificial protrusions 46 during a balancing operation using a suitable technique. For instance, one can chose to drill an axially-extending bore through one of the sacrificial protrusions 46 and/or remove surface material entirely or partially from the end face 44*a* thereof. Material removal may involve mechanical machining or non-mechanical techniques, as desired, as will be appreciated by a person skilled in the art, and therefore the material removal step needs not be discussed in further detail. Material removal may be confined to the zone axially delimited by the end face 44*a* of the appendage 40 and by a radially-extending plane coincident with the bottom ends 48*a* of the slots 48 (i.e. the deepest point of each slot 48), and further may be confined to a suitable distance away from said plane, indicated in FIG. 3 by the imaginary line 50 that is closer to the free end 44*a* than from the plane defined by the bottom ends 48*a* of the slots 48, to provide for a desired safety margin or safety zone.

Balancing the rotor disc assembly 10 can require that it be rotated at a given minimum speed for evaluating if it is balanced or not. For instance, in some designs used in turbomachines, the blades 30 can be somewhat loosely fixed in their corresponding slot 32 when the assembly 10 is static and be only brought to their proper radial position when the assembly 10 is rotated at high speeds. Various techniques can be used for conducting a balancing assessment and calculate the position and the amount of material to be removed, as will be understood by a person skilled in the art, and therefore these techniques need not be discussed in further detail. Furthermore, a balancing with weight removal as presented herein does not exclude that another balancing technique be used simultaneously to compensate for a portion of the imbalance, for example a blade permutation.

Overall, the above description is meant to be exemplary only, and one skilled in the art will recognize that changes may be made to what is described while still remaining within the same concept. For example, the rotor disc can be different in shape from the one that is shown in the figures. The rotor balancing assembly described may be provided in any suitable manner, and need not be provided on an appendage, per se, nor be provided on a single annular device such as the appendage described. The assembly(ies) or appendage(s) may have any suitable configuration and/or shape. The protrusions not need to be a flat, nor axially extending, nor provided in and radially-extending surface. All protrusions and slots need not be configured or shaped identically. Still other modifications will be apparent to those skilled in the art, in light of a review of this disclosure, and such modifications are intended to fall within the scope of the appended claims.

What is claimed is:

1. A gas turbine rotor disc comprising at least one annular appendage projecting axially from a face of the rotor disc, with a plurality of circumferentially sacrificial protrusions in the annular appendage delimited circumferentially by stress-relieving slots disposed between and defining the protrusions, the protrusions in the at least one annular appendage provided in a circular array coaxially disposed with reference to a central rotation axis of the rotor disc, the protrusions projecting from a bottom end of adjacent slots to a free end, the protrusions configured to permit selective removal of a portion of the free end to thereby balance the rotor.

2. The rotor disc as defined in claim 1, wherein the protrusions comprise sufficient material to permit multiple balancing operations during a service life of the rotor disc.

3. The rotor disc as defined in claim 1, wherein the at least one annular appendage is monolithically integral with the rotor disc.

4. The rotor disc as defined in claim 3, wherein the appendage extends from a radially-extending face of the rotor disc.

5. The rotor disc as defined in claim 3, wherein the stress-relieving slots are provided on an end face of the free end of the appendage.

6. The rotor disc as defined in claim 1, wherein the stress-relieving slots are scallop shaped.

7. The rotor disc as defined in claim 1, wherein the protrusions extend axially with reference to the central rotation axis.

8. The rotor disc as defined in claim 7, wherein the slot bottom ends define a radially-extending plane.

9. The rotor disc as defined in claim 1, wherein the rotor disc has a corresponding appendage on each of its two faces.

10. The rotor disc as defined in claim 1, wherein each slot has a bottom end and wherein the slots have a shape configured to provide a stress concentration below a crack propagation threshold in a region of the bottom end.

* * * * *